US009328396B2

(12) United States Patent
Abbruzzese et al.

(10) Patent No.: US 9,328,396 B2
(45) Date of Patent: May 3, 2016

(54) PROCESS FOR THE PRODUCTION OF GRAIN-ORIENTED MAGNETIC SHEETS

(75) Inventors: Giuseppe Abbruzzese, Rome (IT); Stefano Cicale, Rome (IT); Stefano Fortunati, Rome (IT)

(73) Assignee: CENTRO SVILUPPO MATERIALI S.P.A., Rome (IT)

( * ) Notice: Subject to any disclaimer, the term of this patent is extended or adjusted under 35 U.S.C. 154(b) by 875 days.

(21) Appl. No.: 13/532,545

(22) Filed: Jun. 25, 2012

(65) Prior Publication Data

US 2013/0160897 A1 Jun. 27, 2013

Related U.S. Application Data

(63) Continuation-in-part of application No. PCT/IT2010/000508, filed on Dec. 22, 2010.

(30) Foreign Application Priority Data

Dec. 23, 2009 (IT) ..... RM2009A000681

(51) Int. Cl.

| | |
|---|---|
| ***C21D 8/02*** | (2006.01) |
| ***C21D 8/12*** | (2006.01) |
| ***H01F 41/00*** | (2006.01) |
| ***C21D 8/04*** | (2006.01) |
| ***C22C 38/02*** | (2006.01) |
| ***C22C 38/60*** | (2006.01) |
| ***H01F 1/18*** | (2006.01) |
| *B21B 1/22* | (2006.01) |

(52) U.S. Cl.

CPC ..... *C21D 8/1222* (2013.01); *C21D 8/04* (2013.01); *C21D 8/1244* (2013.01); *C21D 8/1261* (2013.01); *C22C 38/02* (2013.01); *C22C 38/60* (2013.01); *H01F 1/18* (2013.01); *H01F 41/00* (2013.01); *B21B 1/22* (2013.01)

(58) Field of Classification Search

CPC .. C21D 8/1222; C21D 8/1244; C21D 8/1261; C22C 38/02

See application file for complete search history.

(56) References Cited

U.S. PATENT DOCUMENTS

| | | | | |
|---|---|---|---|---|
| 5,296,050 | A * | 3/1994 | Takamiya et al. | 148/111 |
| 5,472,521 | A * | 12/1995 | Yoshitomi et al. | 148/111 |
| 6,296,719 | B1 | 10/2001 | Fortunati | |
| 6,444,050 | B1 * | 9/2002 | Komatsubara | C21D 8/1294 148/111 |
| 2008/0216985 | A1 | 9/2008 | Gunther | |
| 2012/0222777 | A1 * | 9/2012 | Fortunati et al. | 148/208 |

FOREIGN PATENT DOCUMENTS

| | | | |
|---|---|---|---|
| EP | 1473371 | A2 | 11/2004 |
| JP | 2002-212639 | A | 7/2002 |
| WO | 98/10104 | A1 | 3/1998 |
| WO | 98/46802 | A1 | 10/1998 |
| WO | 98/48062 | A1 | 10/1998 |

OTHER PUBLICATIONS

International Search Report Dated Apr. 27, 2011.

* cited by examiner

*Primary Examiner* — Jie Yang
*Assistant Examiner* — Xiaowei Su
(74) *Attorney, Agent, or Firm* — Hedman & Costigan, P.C.; James V. Costigan; Kathleen A. Costigan

(57) ABSTRACT

The present invention has as objective a procedure for the oriented-grain magnetic sheet that provides particular operative hot rolling mill conditions of silicon steel slabs, by means which it is possible to highly contain the heterogeneities of hot rolled sheet re-crystallization. The use of these operative conditions permits to reduce the growing tendency of the crystallized grain during the annealing of the sheets at a final thickness that precedes the secondary oriented re-crystallization. Contemporarily, the particular operational conditions of hot rolling mill according to the invention permit a fine precipitation of secondary phases useful to the control of the grain growing, starting from a quantity of sulphur (S) and nitrogen (N) in matrix lower than corresponding provided by the conventional technologies and consequently disposable in metallic solid solution before the rolling after the heating of the slabs at temperature values lower than 1300° C.

14 Claims, No Drawings

PROCESS FOR THE PRODUCTION OF GRAIN-ORIENTED MAGNETIC SHEETS

This application is a continuation in part of PCT/IT2010/000508, filed Dec. 22, 2010 which claims the priority of Italian Application Serial No. RM2009A000681, filed Dec. 23, 2009.

DESCRIPTION

The present invention refers to the production of iron alloy sheets containing silicon for electric applications with high degree of magnetic anisotropy and excellent magnetic characteristics along the rolling direction of the ribbons, known as oriented grain magnetic sheets.

The invention consists in a new procedure for the production of said products which, through a particular control of the thermo-mechanic process of the hot rolling, the conditions for the control of the secondary re-crystallization phenomena oriented at final thickness and the obtaining of finished products with excellent magnetic characteristics and particularly homogeneous are favoured.

As well known, oriented grain magnetic sheets are commonly classified in two classes of product that differ for the magnetic induction value measured under the action of a field of 800 As/m (B800): conventional oriented grain magnetic sheets (CGO–B800>1800 mT), and high permeability oriented grain magnetic sheets (HGO–B800>1900 mT).

Oriented grain magnetic sheets are utilized, in particular, in the construction of the nuclei of electric transformers used along all the cycle of electric energy production and distribution (from the power plant until the final users). The qualifying magnetic characteristics of these materials, besides the magnetic permeability along the reference direction (magnetization curve in the direction of the sheets rolling) are the power losses, principally dispersed under heat form, for the application of an alternate electromagnetic field (50 Hz in Europe) in the same reference direction in which the magnetic flux flows and at the work inductions of the transformer (typically power losses at 1.5 and 1.7 Tesla are measured).

The excellent magnetic characteristics in the direction of strips rolling are the result of the peculiar polycrystallic structure of the finished products characterized by a crystals distribution that constitute the metallic matrix that are passing the sheets thickness and whose crystallographic orientation is such that the direction <001> of the lattice of about all the present crystals (according to Miller indexes) aligned along the strips rolling direction.

Since the crystallographic direction <001> is the most simple magnetization direction of the body-centred cubic lattice, this guarantees the achievement of the best possible permeability for the polycrystal. The relative alignment degree between the single crystal directions <001> (between them and with the rolling direction) in terms of angular deviation is directly proportional to the magnetic permeability obtainable on the product. The best products (HGO degree) show the greater part of crystals with a medium disorientation within an angular dispersion cone of 3-4 degrees. In the case of conventional oriented grain products (CGO) the maximum angular dispersion cone, within which the maximum part of the crystals constituting the product are disposed, turns out to be of 7-8 degrees on average.

Such crystal structure of the products is obtained in the industrial production by controlling the continuous growing of the grain after crystallization of the rolled sheets at final thickness and subsequently a discontinuous growing of the grain that is known to the experts in the art as secondary oriented recrystallisation.

For the production of oriented grain magnetic sheets, it is necessary to regulate the presence of a quantity and a distribution of second phases particles that critically reduce the grain edges movement at high temperature (grain growth inhibitors) and allow the control of the secondary oriented recrystallisation.

The particles amount (volumetric fraction of the precipitates) is determined by the content of some elements such as sulphur and/or selenium, nitrogen that are potentially capable to form sulphurs and/or selenides and nitrures sufficiently stable at high temperature with many elements (for example manganese, cuprum, chromium, aluminium, niobium, vanadium, titanium, etc.).

Other particles types cannot be used since they are not much stable at high temperature (for example carbides) or too much stable and for this reason they are not eliminable from the matrix at the end of the process (for example oxides).

Furthermore, for an efficient control of the grain growth, it is important that the particles of the second phases are very small and uniformly distributed in the matrix.

An analytic expression that describes the braking force intensity of the grain edges movement is the following equation (1):

$$Iz(\mathrm{cm}^{-1}) = \frac{6}{\pi} * \frac{fv}{\bar{r}}$$

where fv the volumetric fraction of secondary phases and $\bar{r}$ is the average value of the actual secondary phases dimensions (expressed as spherical equivalent radius).

As well known at those skilled in the art, the process phase for which the control of the crystal grain growth in these steels is critical is that goes from the primary crystallisation that is realised on semi-products after the cold rolling at final thickness (typically during the continuous annealing), until the secondary re-crystallization that is realised during the final annealing at high temperature (typically the static annealing). The braking force has to be such to uniformly work in all the matrix and to contain the grain growth of an initial structure of primary crystallisation with a spherical equivalent diameter of the average crystal grain that is of the order for example of 5-15 μm.

A tendency of the grain edges to migrate, activated by the temperature, is due to such starting crystal structure, and so, a propension to growth of the average dimensions of the crystal grain obtainable from the following expression (2):

$$DF = \frac{1}{\phi} - \frac{1}{\phi_{max\square}}$$

with "DF" (growth Driving Force) that can be expressed in $\mathrm{cm}^{-1}$ too, and wherein ø represents the average dimension of the grain as expressed in cm and $ø_{max\square}$ the dimension of the class of distribution biggest grains, still expressed in cm (for both, one commonly refers to the spherical equivalent radius respectively of the average and of the biggest grain class). The values of ø and $ø_{max\square}$ can be easily evaluated by means of simple observations of the micro-structure at the optical microscope and in the case of the oriented grain rolled sheets production and in absence of abnormal structural non-homogeneity they are so that the "DF" is in the range of values between 1000 e 3000 $cm^{-1}$.

In order to contain such a tendency to growth, the braking force of the inhibitors as defined in the equation (1) has to be properly balanced by regulating the volumetric fraction of the precipitates and their average dimension.

In the conventional productive processes for the production of oriented grain sheets, the volumetric fractions of secondary phases in the metallic matrix, typically adopted for the control of the grain growth and of the secondary oriented recrystallisation, are of the order of magnitude of 0.001-0.002 (0.1-0.2%) that correspond to, for example, a controlled precipitation in fine form of 0.030%-0.040% in weight of sulphur and/or nitrogen (for example as MnS and AlN).

Given the solubility of sulphur and nitrogen in presence of suitable amount of aluminium and manganese in matrix, in order to homogeneously precipitate, and in a fine form, the mentioned second phases, it is necessary, before hot rolling the solidified material, to heat at very high temperature (>1300° C.) in order to melt sulphurs and/or nitrides precipitated during the slow cooling after the slabs solidification, and precipitate them again in fine form during the fast cooling under controlled deformation in hot rolling and eventually the subsequent strips annealings.

Such a thermal treatment at high temperature imposes high energetic consumption, the necessity of special heating furnace, the presence of liquid or doughy slags during the process and the consequent high incidence of superficial defects.

In order to overcome these inconveniences, different alternative techniques of production have been recently proposed.

In WO9846802 and WO9848062, fabrication processes of oriented grain sheets are described that utilise the thin slab technologies, the control of the contents of Mn, S, (S+Se), Cu, Al, N and other elements potentially involved in the preparation of the grain growth inhibition distribution in ranges defined so as to guarantee, within the limits of feasible heating conditions the precipitated fraction dissolution during the cast cooling and the sulphurs and nitrides precipitation in fine form during and/or after the hot rolling phase.

In EP0922119 and EP0925376 the adoption of other chemical compositions and cycles of subsequent transformations is described, with which it is possible to industrially obtain products of quality and with good yields, also with the adoption of nitruration techniques at the solid state for increasing the volumetric fraction of the grain growth inhibitors before the secondary oriented recrystallisation.

Different proposed solutions show specific shrewdnesses in order to obtain, under the constraints of maximum temperature that is feasible for the heating/homogenisation of the solidified material before the hot rolling, the amount and distribution of grain growth inhibitors necessary to the control of the secondary oriented recrystallisation for the obtainment of products with excellent magnetic characteristics, so as to guarantee an "inhibition" of the grain growth (distribution of non-metallic secondary phases), homogeneously present in the matrix before the secondary recrystallisation at least equal or larger than 1300 $cm^{-1}$.

An alternative methodology for the control of the grain growth before and during the secondary oriented recrystallisation is to operate in such a manner to reduce the tendency of the crystal grain to grow (see equation (2)), for example by means of the reduction of the heterogeneities of recrystallisation in the different production process phases.

A way to obtain, on industrial strips, homogeneous primary recrystallisation structures is to augment the cold reduction rate so as to generate in the deformed structure high density of dislocations that are homogeneously distributed in the matrix even in presence of starting heterogeneous structures. Such strategy implies however the necessity to proportionally augment the hot sheet thickness (considering the final thickness of the product as fixed) with a proportional costs burden for the cold rolling and of physical yield reduction (number of breaks in cold rolling proportionally larger than in the case of higher reduction yields). In addition, as known, upon augmenting applied rate of cold reduction, the primary recrystallisation grains dimension is proportionally reduced. This implies an augmentation of the grain growth tendency (as derivable from the relation (1)) that consequently requires a management of larger values of grain growth inhibitors for the control of the products final quality.

Alternatively, by utilising the cold rolling process, it is possible to recover micro-structural homogeneity carrying out cold rollings in more phases spaced out by intermediate annealings, though with an increase of transformation costs.

The inventors of the process according to the present invention have performed different studies on the possibility to reduce the micro-structural heterogeneities of the recrystallised cold rolled sheets produced during the production of oriented grain sheets, by setting the modalities with which the cast slabs are transformed into strips. In particular, they have identified some operational conditions of slabs hot rolling by means of which it is possible to highly contain the heterogeneities of recrystallisation of hot rolled strips with subsequent reduction of the tendency to growth of the recrystallised grain in the annealing of final thickness ribbons, that precedes the secondary oriented recrystallisation process and, at the same time, to generate a fine precipitation of the second phases useful to the control of the grain growth starting from amounts of sulphur (S) and nitrogen (N) in matrix smaller than that provided by the conventional technologies and consequently available in metallic solid solution before the rolling after the heating of the slabs at a temperatures lower than 1300° C.

In the process of the present invention, the Si contents has to be higher than 2% in order to raise the static final annealing temperature at values necessary to the correct development of the secondary oriented recrystallisation without that phenomena of ferrite-austenite-ferrite phase transitions are simultaneously realized that compromise the final micro-structure control and thus the magnetic characteristics of the finished products with particular regard to the magnetic permeability measured along the rolling direction. For Si contents higher than 4.5%, it has been noted a critical increase of the ductile-fragile transition temperature of the material that causes physical yield problems of the productive process until the finished products industrial production would be no longer convenient.

In the present invention, the slabs heating necessary to hot roll the material until the obtainment of rolled up strips is conducted preferably at a temperature not lower than 1100° C. and not higher than 1300° C.

Heating temperatures lower than 1100° C., even if possible, are not convenient since the separation forces necessary for the subsequent hot rolling become too much elevated. Heating temperatures lower than 1300° C. does not lead to significant advantages on the rolling process whilst entail inconvenients connected to the formation of superficial oxidation until liquid or doughy slag for temperatures higher than 1300° C., slabs movements in the heating furnace due to the excessive ductility and thus slabs foldability over the supports. Besides, the containment of the process temperature value lower than 1300° C. permits to use of conventional type heating furnace and the containment of energetic consumptions associated to the process.

The present invention allows to control the precipitation of secondary non-metallic phases (sulphurs, nitrides, . . . ) in the metallic matrix of the hot strips produced with defined density and dimensions, based on a hot rolling process performed in at least two different phases by means the use of two different hot rolling mill plants. The two phases of hot rolling are mutually separated by a physical space so that the first hot rolling effected on the first roughcast rolling mill produces a semi-product that is transferred, by suitable means such as for example a roller way, to the second finishing hot rolling that transform the semi-product (bar) in a hot rolled sheet with a defined final thickness. Said hot rolled strip, so produced, is conveniently wrapped up in ribbon form and thus sent to the subsequent thermo-mechanic treatments provided by the invention.

The transfer of the roughcast from the first rolling mill to the second rolling mill have to occur in such a manner that the final rolling temperature at the first rolling mill is higher or equal to the initial temperature of the second rolling mill. In order to limit the cooling during the transfer from the roughcast rolling mill to the finishing rolling mill, the space between the two rolling mills can be protected by thermal isolation passive panels.

The transfer time of the bar between the end of the roughcast rolling and the start of the finishing rolling has to be at least of 5 s. Such a minimum time is necessary for activating in the metallic matrix the phenomena of static recrystallisation before the second hot rolling. Such transfer time however does not have to exceed 60 s so as to limit the unwanted precipitation and growing of second phases particles such as sulphurs and nitrides.

The first hot rolling (roughcasting) is realised by means a roughcast rolling mill that can be of both reversible and continuous type with one or more rolling cages, and is conduced so to prepare a rolled semi-product (bar) having a thickness not higher than 40 mm, that before the second rolling phase is maintained at a temperature higher than 950° C. and such to limit the precipitation of the elements potentially capable to form, in the metallic matrix, second non-metallic phases for a fraction not higher than 20%.

It is important that the roughcast rolling temperature, with which the bar is produced, does not decrease under 950° C.; indeed the inventors have unexpectedly found that by applying a rapid complex reduction higher than 75% in the prescribed temperature range, the second non-metallic phases precipitation after the roughcast does not occur, even in stable thermodynamic conditions favourable to the precipitates.

For reduction rate lower than 75%, a high amount of sulphur and/or nitrogen precipitated under form of sulphurs and or nitrides with dimensions relatively too high for guaranteeing a correct control of the grain growing (equivalent spherical diameter higher than 0.2 μm) at the end of the roughcast rolling and before the finishing rolling.

A possible explanation of this behaviour is that for rates smaller than 75% and at temperature values higher than 900° C., the lattice defects generated during the hot deformation remain in the deformed material in relatively high amount and they are not homogeneously segregated in the metallic matrix, thereby forming the nuclei for a localised precipitation of sulphurs and/or nitrides. Moreover, in the same conditions of temperature and in the case of deformations higher than 75%, recrystallisation phenomena are likewise favoured that rapidly eliminate from the matrix the greatest part of lattice defects, inhibiting the precipitation of sulphurs and/or nitrides particles.

The second rolling process, by which the bar is hot transformed into strip, is carried out in such a manner that the second phases, potentially precipitable, precipitate in a diffuse form, homogeneously and in small dimensions (preferably with a spherical equivalent diameter smaller than 0.2 μm).

The inventors of the present invention have found that the material thickness at which the deformation is applied have not to be higher than 40 mm so as to realise, during the first reduction step of said second rolling, two simultaneous and synergic phenomena, that are the very rapid generation of a high quantity of defects homogeneously distributed in the whole metallic matrix and a quick cooling of the deformed material that limits the dynamic recovery of the generated lattice defects and augments the thermodynamic stability of the second phases potentially precipitable. Such metallurgical conditions are favoured by the application of a thickness reduction realised during the first finishing rolling passage that is higher or equal to 40%.

The second hot rolling, named finishing rolling, has to be realised in more subsequent different steps, such as three different sequential steps. After the execution of the first step of the second hot rolling process (where almost all the fraction of second non-metallic phases is precipitated) the procedure according to the invention provides for the accomplishment of at least a thermal treatment for completing the precipitation processes and for homogenising the dimensional distribution of the inclusions by means of dissolution processes and growth of the precipitates activated by the temperature.

The inventors of the present production process have found that said controlled thermal treatment (in one or more different phases) between the first step and at least one of the subsequent rolling steps, produces a micro-structure of the hot ribbons that are more recrystallised with respect to the case in which similar intermediate thermal treatments are not carried out or are carried out for a time shorter than that suggested by the present invention.

Such thermal treatment can be industrially realised utilising any technique suitable for the purpose, such as heating stations situated between one or more rolling mill cages for finishing rolling trains with more cages and continuous and/or heating station placed before or after cages of reversible-type finishing rolling mills. The thermal treatment can be done with different heating technique such as, for example, electromagnetic induction heating or with radiant heating elements inserted in panels or closed chambers.

It is subject matter of the present invention a process for the production of oriented grain magnetic sheets, wherein a steel slab including, in weight percentage, C 0.010-0.100%, Si 2.0-4.5%, Al 0.005-0.050%, N+S≤0.030% undergoes, after casting and solidification, a thermo-mechanical cycle comprising the following operations:

a) annealing at a temperature value in the range of 1100-1300° C.;
b) hot roughcast rolling, in a first roughcast rolling mill, in at least two subsequent rolling steps, until the obtaining of a bar having a thickness not higher than 40 mm, with a reduction rate of the total thickness higher than 75% and with a rolling temperature higher than 950° C.,
c) transfer of the so produced bar from the first roughcast rolling mill to a second finishing rolling mill in a time in the range of 5 to 60 s,
d) hot finishing rolling, in a second finishing rolling mill, in at least two steps of subsequent rolling, the first rolling step with a thickness reduction higher than 40% and temperatures in the range of 900° C. to 1100° C., and the second and preferably the last rolling step with a thickness reduction rate lower than 25% and temperatures not higher than 850° C., e) being the hot rolled sheet subjected, during said hot finishing rolling, between the first step and at least one of the subsequent step of rolling, to at least a thermal treatment in the temperature range of 800° C. to 1100° C. and in the time range comprised between 10 and 900 s.

In an embodiment of the process according to the invention, the steel slab to be subjected to the thermo-mechanical cycle contains: C 0.010-0.100%; Si 2.5-3.5%; S+(32/79)Se 0.005-0.025%; N 0.002-0.006%; at least an element between Al, Ti, V, Nb, Zr, B, W for a total weight percentage not higher than 0.035%; at least one of the elements in the series: Mn, Cu for a total weight percentage not higher than 0.300%; and possibly at least one of the element in the series of Sn, As, Sb, P, Bi for a total weight percentage not higher than 0.150%, the remainder being iron apart from the inevitable impurities.

The heating time necessary for the present invention depends on the range of temperature at which one realises the thermal treatment and is regulated according to the following scheme:

t minimum=10 s for heating temperature 1050° C.≤T<1100° C.

t minimum=20 s for heating temperature 1000° C.≤T<1050° C.

t minimum=60 s for heating temperature 950° C.≤T<1000° C.

t minimum=100 s for heating temperature 900° C.≤T<950° C.

t minimum=300 s for heating temperature 800° C.≤T<900° C.

For the invention objects, the thermal treatment can be realised in one or more different phases during the finishing hot rolling in the range of the prescribed temperature (800-1100° C.) within at least one of the above-defined minimum times in temperature.

Besides, in the case of heatings conducted at temperature higher than 1000° C., it is suitable to limit the thermal treatment time in temperature at the maximum values defined in the following scheme:

t maximum=180 s for heating temperature 1050° C.≤T≤1100° C.

t maximum=300 s for heating temperature 1000° C.≤T<1050° C.

t maximum=600 s for heating temperature 950° C.≤T<1000° C.

t maximum=900 s for heating temperature 900° C.≤T<950° C.

t maximum=900 s for heating temperature 800° C.≤T<900° C.

Indeed, for temperature values higher than 950° C., during treatment times higher than those suggested in the above-mentioned scheme both phenomena of dissolution and precipitated particles growth can occur, that can be hardly controlled in a reproducible manner, and they generate variable levels of inhibition to the crystal grain growth and so produce micro-structural and then magnetic instability of the finished products, not suitable for an industrial production. The inventors of the process according to the present invention have found that, for treatment times lower or higher than the provided limits, the product magnetic characteristics worsen, showing a high instability of the results.

The so prepared hot rolled strip is then transformed into finished product by a treatment cycle comprising the following process steps:

possible continuous hot annealing of the strip cold rolling at final thickness in one or more steps with possible intermediate annealing, primary recrystallisation continuous annealing and possible decarburation at solid state, high temperature static annealing of secondary oriented recrystallisation, thermo-smoothing annealing and deposition of the insulating covering.

After the thermo-smoothing and the deposition of an insulating covering, the strip can be optionally subjected to a refinement treatment of the magnetic dominia that consists preferably in a surface laser marking.

In a variation of the present invention, the recrystallisation annealing of the strips resulting from the cold rolling is conducted in nitriding atmosphere so as to augment the average nitrogen content of the strips by an amount higher than 0.001% and preferably comprised between 0.001% and 0.030%.

The solidified slabs thickness can be in the range of 50 to 120 mm and preferably the finishing rolling is done by means of a reversible type rolling mill.

So far, a general description of the present invention has been given. With the help of the following examples, that are given by way of illustration but not by way of limitation, a description of its embodiments will be now furnished, which are finalised to better understand features, advantages, operating modes and purposes.

EXAMPLE 1

A sample of steel containing 3.1% silicon, 0.058% carbon, 0.025% aluminium, 0.021% sulphur and 0.0062% nitrogen has been solidified at a thickness of 100 mm. Three samples of the so produced material have been subjected to hot rolling in the following described conditions:

Annealing at 1150° C. for a permanence time in the furnace, at the treatment temperature, of 20 min;

First hot roughcast rolling with a thickness reduction from 100 mm until 12 mm and performed so as that the last reduction step is realised at the temperature of 1020° C.;

Second hot finishing rolling with thickness reduction from 12 mm until 2.3 mm performed 30 s after the roughcast rolling and so as that with the first rolling step the thickness went from 12 mm to 5 mm and before the continuing of the finishing rolling until the final thickness of 2.3 mm the pieces have been maintained at 1040° C. for a different time for each test samples and respectively for 10 s (A) 120 s (B) and 480 s (C);

The so produced hot rolled sheets have been then annealed at 1080° C. for 20 s, cold rolled in a single phase up to the thickness of 0.30 mm, subsequently recrystallised in a decarburating atmosphere at the temperature value of 850° C. for 120 s and finally subjected to a static annealing up to the temperature value of 850° C. in an atmosphere containing nitrogen in order to increase the nitrogen content of about 150 ppm.

The rolled sheets have been subjected to a static annealing up to the temperature value of 1200° C. in an atmosphere containing hydrogen in order to develop a secondary recrystallisation and remove from the metallic matrix the nitrogen and the sulphur initially present in the material. At the end of the process, the sheets produced in the three different conditions have been subjected to magnetic measurements. Measurement results have been synthetically shown in Table 1.

TABLE 1

| Condition | Time at 1040° C. | B 800 (Tesla) | P 17 (W/Kg) | |
|---|---|---|---|---|
| A | 10 s | 1.69 | 2.16 | (*) |
| B | 120 s | 1.95 | 0.97 | invention |
| C | 480 s | 1.65 | 2.10 | — (*) |

(*) comparative example out of the invention field

EXAMPLE 2

Five different steels with different sulphur, nitrogen and aluminium concentrations have been produced for a comparative experimentation. In Table 2 the chemical compositions of the five produced alloys are shown.

TABLE 2

| Element | Steel 1 % p/p | Steel 2 % p/p | Steel 3 % p/p | Steel 4 % p/p | Steel 5 % p/p |
|---|---|---|---|---|---|
| Si | 3.500 | 3.450 | 3.450 | 3.410 | 3.430 |
| C | 0.075 | 0.070 | 0.073 | 0.069 | 0.071 |
| Al | 0.230 | 0.120 | 0.235 | 0.004 | 0.220 |
| Mn | 0.058 | 0.061 | 0.060 | 0.061 | 0.059 |
| Cu | 0.100 | 0.110 | 0.100 | 0.100 | 0.095 |
| Ti | 0.003 | 0.002 | 0.004 | 0.003 | 0.003 |
| Sn | 0.090 | 0.090 | 0.090 | 0.089 | 0.085 |
| S | 0.006 | 0.014 | 0.025 | 0.014 | 0.035 |
| N | 0.009 | 0.007 | 0.010 | 0.007 | 0.005 |

The produced five steels have been solidified in slabs of 200 mm thickness and then hot rolled according to the following cycle:

Annealing at 1280° C. for a permanence time in the furnace at the treatment temperature of 15 min;

First roughcast rolling with a thickness reduction from 200 mm until 23 mm and performed so as that the last reduction step is realised at the temperature of 1150° C.;

Second hot finishing rolling with the thickness reduction from 23 mm until 2.1 mm performed 30 s after the roughcast rolling and so as that with the first rolling step the thickness went from 23 mm to 13 mm and before the continuing of the finishing rolling until the final thickness of 2.1 mm the pieces have been maintained at 1090° C. for 120 s;

The so produced hot rolled sheets have been then annealed at 1050° C. for 20 s, cold rolled in a single phase until the thickness of 0.27 mm, subsequently recrystallised in a decarburating atmosphere at the temperature value of 850° C. for 180 s and finally subjected to a static annealing up to the temperature value of 1200° C. in an atmosphere containing hydrogen in order to develop a secondary recrystallisation and remove from the metallic matrix the nitrogen and the sulphur initially present in the material.

At the end of the process, the sheets produced starting from the five different alloys have been subjected to magnetic measurements. Measurement results have been synthetically shown in Table 3.

TABLE 3

| Steel | S + N | Al | B 800 (Tesla) | P 17 (W/Kg) | |
|---|---|---|---|---|---|
| 1 | 0.015 | 0.230 | 1.92 | 0.83 | invention |
| 2 | 0.020 | 0.120 | 1.91 | 0.85 | invention |
| 3 | 0.035 | 0.235 | 1.65 | 2.10 | (*) |

TABLE 3-continued

| Steel | S + N | Al | B 800 (Tesla) | P 17 (W/Kg) | |
|---|---|---|---|---|---|
| 4 | 0.020 | 0.004 | 1.62 | 2.20 | (*) |
| 5 | 0.040 | 0.220 | 1.65 | 2.06 | (*) |

(*) comparative example out of the invention field

EXAMPLE 3

A sample of steel containing 3.2% silicon, 0.065% carbon, 0.029% aluminium, 0.008% sulphur and 0.007% nitrogen has been solidified at a thickness of 200 mm. After solidification different portions of the casted material have been hot rolled according to different thermo-mechanic cycles starting from a heating in a furnace at a temperature value of 1200° C. for a permanence time, at the treatment temperature, of 15 min. A first group of pieces has been subjected to a roughcast rolling with a thickness reduction from 200 mm to 55 mm (group A), for a second group the thickness reduction has been from 200 mm to 45 mm (group B), for a third group the thickness reduction has been from 200 mm to 35 mm (group C), and for a fourth group the thickness reduction has been from 200 mm to 20 mm (group D). All the roughcast rollings have been conducted so that the last reduction step was performed in a temperature range between 1050° C. and 950° C. All the pieces have been then subjected to a second subsequent hot rolling of finishing within a time of 50 s with a thickness reduction respectively of 55 mm, 45 mm, 35 mm and 20 mm until hot rolled sheets of 2.3 mm thickness. In the case of roughcast sheets at 55 mm the thickness after the first rolling step was in the range of 25-28 mm, in the case of roughcast sheets at 45 mm the thickness after the first rolling step was in the range of 20-22 mm, in the case of roughcast sheets at 35 mm the thickness after the first rolling step was in the range of 13-15 mm whereas in the case of roughcast sheets at 20 mm the thickness after the first rolling step was in the range of 8-9 mm. Immediately before continuing the finishing rolling until the final thickness of 2.3 mm (the same for all the samples) every test piece has been treated in a furnace at the temperature of 980° C. for a permanence time, at this temperature value, of 300 s.

The so produced hot rolled sheets have been cold rolled a first time at a thickness of 1.2 mm, annealed at 1000° C. for 40 s and cold rolled a second time at the thickness of 0.23 mm.

The cold rolled sheets at the final thickness have been then annealed in a decarburating atmosphere at the temperature value of 860° C. for 90 s and subsequently annealed at the same temperature but in a nitriding atmosphere for the increasing of the nitrogen content at 150-200 ppm and finally subjected to a static annealing at a maximum temperature value of 1200° C. for 10 h.

At the end of the process, the sheets produced with the different conditions have been subjected to magnetic measurements. Measurement results have been synthetically shown in Table 4.

TABLE 4

| | Condition | | | | | |
|---|---|---|---|---|---|---|
| | bar thick-ness mm | Reduction at roughcast % | Reduction at 1° finishing step % | B800 Tesla | P17 (50 Hz) W/Kg | —(*) |
| Group A - test 1 | 55 | 72.5 | 54 | 1.63 | 1.98 | —(*) |
| Group A - test 2 | 55 | 72.5 | 49 | 1.65 | 2.03 | (*) |
| Group A - test 3 | 55 | 72.5 | 50 | 1.62 | 2.10 | —(*) |
| Group B - test 1 | 45 | 77.5 | 51 | 1.83 | 1.25 | —(*) |
| Group B - test 2 | 45 | 77.5 | 55 | 1.75 | 1.52 | —(*) |
| Group B - test 3 | 45 | 77.5 | 53 | 1.65 | 1.98 | —(*) |
| Group C - test 1 | 35 | 82.5 | 60 | 1.81 | 0.85 | invention |
| Group C - test 2 | 35 | 82.5 | 63 | 1.91 | 0.83 | invention |
| Group C - test 3 | 35 | 82.5 | 57 | 1.90 | 0.84 | invention |
| Group D - test 1 | 20 | 90 | 55 | 1.92 | 0.82 | invention |
| Group D - test 2 | 20 | 90 | 60 | 1.92 | 0.82 | invention |
| Group D - test 3 | 20 | 90 | 57 | 1.92 | 0.83 | invention |

(*) comparative example out of the invention field

EXAMPLE 4

A sample of steel containing 3.2% silicon, 0.032% carbon, 0.015% aluminium, 0.068% manganese, 0.085% cuprum, 0.0140% sulphur and 0.0080% nitrogen has been solidified at a thickness of 70 mm. Following a heating at about 1290° C. for a permanence time in the furnace of 15 min at the treatment temperature, the produced material has been hot rolled in different conditions.

A first part of the material (A) has been hot rolled operating a first roughcast from 70 mm to 15 mm in three reduction steps at a final rolling temperature of 900° C. and, after 40 s, a second finishing rolling from 15 mm to 2.3 mm in three reduction steps; between the first and the second step and between the second and the third step of said finishing rolling, the semi-products under rolling have been heated and maintained at the temperature of 940° C. for 90 s, between the first and the second step, and at the temperature of 910° C. for 90 s, between the second and the third step.

A second part of the material (B) has been hot rolled operating a first roughcast from 70 mm to 15 mm in three reduction steps at a final rolling temperature of 1050° C. and, after 40 s, a second finishing rolling from 15 mm to 2.3 mm in three reduction steps; between the first and the second step and between the second and the third step of mentioned finishing rolling, the semi-products under rolling have been heated and maintained at the temperature of 940° C. for 30 s, between the first and the second step, and at the temperature of 910° C. for 30 s, between the second and the third step.

A third part of the material (A) has been hot rolled operating a first roughcast from 70 mm to 15 mm in three reduction steps at a final rolling temperature of 900° C. and, after 40 s, a second finishing rolling from 15 mm to 2.0 mm in three reduction steps; between the first and the second step and between the second and the third step of said finishing rolling, the semi-products under rolling have been heated and maintained at the temperature of 940° C. for 90 s, between the first and the second step, and at the temperature of 910° C. for 90 s, between the second and the third step.

The so produced hot rolled sheets have been then annealed at 1000° C. for 30 s, cold rolled in a single step until the thickness of 0.35 mm, afterwards re-crystallised in a decarburating atmosphere at the temperature of 850° C. for 90 s and subjected to a static annealing until the temperature of 1200° C. in an atmosphere containing hydrogen.

At the end of the process, the sheets produced with the different hot rolling mill conditions have been subjected to magnetic measurements. Measurement results have been synthetically shown in Table 5.

TABLE 5

| Condition | Fine roughcast Temperature (° C.) | B 800 (Tesla) | P 17 a 50 Hz (W/Kg) | |
|---|---|---|---|---|
| A | 900 | 1.65 | 2.45 | —(*) |
| B | 1050 | 1.75 | 2.01 | —(*) |
| C | 1050 | 1.92 | 1.10 | invention |

(*)comparative example out of the invention field

The invention claimed is:

1. A process for the production of oriented grain magnetic strip, wherein a steel slab consisting of, in weight percentage, C 0.010-0.100%, Si 2.0-4.5%, Al 0.005-0.050%, N plus S<0.030%, and as a first optional component Se may be present such that S plus (32/79) Se is in the range of 0.005-0.025%, and as a second optional component at least an element selected from Al, Ti, V, Nb, Zr, B, W may be present for a total weight percentage not higher than 0.035%, and as a third optional component at least one of the elements in the series Mn, Cu for a total weight percentage not higher than 0.300% may be present and as a fourth optional component at least one of the elements in the series of Sn, As, Sb, P, Bi for a total weight percentage not higher than 0.150%, may be present the remainder being iron apart from impurities, undergoes, after casting and solidification, a thermo-mechanical cycle comprising the following operations:

a) heating at a temperature value in the range of 1100-1300° C.;

b) hot roughcast rolling, in a first roughcast rolling mill, in at least two subsequent rolling steps, until the obtaining of a bar having a thickness not higher than 40 mm, with a reduction rate of the total thickness higher than 75% and with a rolling temperature higher than 950° C., c) transfer of the so produced bar from the first roughcast rolling mill to a second finishing rolling mill in a time in the range of 5 to 60 s, d) hot finishing rolling, in a second finishing rolling mill, in at least two steps of subsequent rolling, the first rolling step with a thickness reduction higher than 40% and temperatures in the range of 900° C. to 1100° C., and the second and last rolling step with a thickness reduction rate lower than 25% and temperatures not higher than 850° C., e) being the hot rolled sheet subjected, during said hot finishing rolling, between the first step and at least one of the subsequent step of rolling, to at least a thermal treatment in the temperature range of 800° C. to 1100° C. and in the time range comprised between 10 and 900 s wherein wherein the hot rolled sheet undergoes a thermal treatment in the temperature range of 800-1000° C. for a whole permanence minimum time set according to the following scheme:

t minimum=10 s for heating temperature 1050° C.<T<1100° C.

t minimum=20 s for heating temperature 1000° C.<T<1050° C.

t minimum=60 s for heating temperature 950° C.<T<1000° C.

t minimum=100 s for heating temperature 900° C.<T<950° C.

t minimum=300 s for heating temperature 800° C.<T<900° C.

2. Process according to claim 1, wherein the hot rolled strip is transformed into finished product by a treatment cycle comprising the following process steps:

continuous hot annealing of the strip cold rolling at final thickness in one or more steps with intermediate annealing, primary recrystallisation continuous annealing and optional decarburation at solid state, high temperature static annealing of secondary oriented recrystallisation, flattening annealing and deposition of the insulating covering.

3. Process for the production of oriented-grain magnetic sheets according to claim 2, wherein after the flattening annealing and the deposition of an insulating covering, the strip are subjected to a refinement treatment of the magnetic dominia.

4. Process for the production of oriented-grain magnetic sheets according to claim 3, wherein a refinement treatment of the magnetic dominia is surface laser marking.

5. Process for the production of oriented-grain magnetic sheets according to claim 3, wherein before the static annealing at secondary recrystallisation high-temperature, a nitriding thermal treatment is effected in order to introduce into the strips a nitrogen amount comprised between 10 and 300 ppm.

6. Process for the production of oriented-grain magnetic sheets according to claim 2, wherein the solidified slab thickness is comprised between 50 and 120 mm.

7. Process for the production of oriented-grain magnetic sheets according to claim 2, wherein the finishing rolling is effected by means of reversible-type rolling mill.

8. A process for the production of oriented grain magnetic strip, wherein a steel slab consisting of, in weight percentage, C 0.010-0.100%, Si 2.0-4.5%, Al 0.005-0.050%, N plus S<0.030%, and as a first optional component Se may be present such that S plus (32/79)Se is in the range of 0.005-0.025%, and as a second optional component at least an element selected from Al, Ti, V, Nb, Zr, B, W may be present for a total weight percentage not higher than 0.035%, and as a third optional component at least one of the elements in the series Mn, Cu for a total weight percentage not higher than 0.300% may be present and as a fourth optional component at least one of the elements in the series of Sn, As, Sb, P, Bi for a total weight percentage not higher than 0.150%, may be present the remainder being iron apart from impurities, undergoes, after casting and solidification, a thermo-mechanical cycle comprising the following operations:

a) heating at a temperature value in the range of 1100-1300° C.;

b) hot roughcast rolling, in a first roughcast rolling mill, in at least two subsequent rolling steps, until the obtaining of a bar having a thickness not higher than 40 mm, with a reduction rate of the total thickness higher than 75% and with a rolling temperature higher than 950° C., c) transfer of the so produced bar from the first roughcast rolling mill to a second finishing rolling mill in a time in the range of 5 to 60 s, d) hot finishing rolling, in a second finishing rolling mill, in at least two steps of subsequent rolling, the first rolling step with a thickness reduction higher than 40% and temperatures in the range of 900° C. to 1100° C., and the second and last rolling step with a thickness reduction rate lower than 25% and temperatures not higher than 850° C., e) being the hot rolled sheet subjected, during said hot finishing rolling, between the first step and at least one of the subsequent step of rolling, to at least a thermal treatment in the temperature range of 800° C. to 1100° C. and in the time range comprised between 10 and 900 s wherein the hot rolled sheet undergoes said thermal treatment for a whole permanence maximum time set according to the following scheme:

t maximum=180 s for heating temperature 1050° C.<T<1100° C.

t maximum=300 s for heating temperature 1000° C.<T<1050° C.

t maximum=600 s for heating temperature 950° C.<T<1000° C.

t maximum=900 s for heating temperature 900° C.<T<950° C.

t maximum=900 s for heating temperature 800° C.<T<900° C.

9. Process according to claim 8, wherein the hot rolled strip is transformed into finished product by a treatment cycle comprising the following process steps:

continuous hot annealing of the strip cold rolling at final thickness in one or more steps with intermediate annealing, primary recrystallisation continuous annealing and optional decarburation at solid state, high temperature static annealing of secondary oriented recrystallisation, flattening annealing and deposition of the insulating covering.

10. Process for the production of oriented-grain magnetic sheets according to claim 9, wherein a refinement treatment of the magnetic dominia is surface laser marking.

11. Process for the production of oriented-grain magnetic sheets according to claim 9, wherein before the static annealing at secondary recrystallisation high-temperature, a nitriding thermal treatment is effected in order to introduce into the strips a nitrogen amount comprised between 10 and 300 ppm.

12. Process for the production of oriented-grain magnetic sheets according to claim 8, wherein after the flattening annealing and the deposition of an insulating covering, the strip are subjected to a refinement treatment of the magnetic dominia.

13. Process for the production of oriented-grain magnetic sheets according to claim 8, wherein the solidified slab thickness is comprised between 50 and 120 mm.

14. Process for the production of oriented-grain magnetic sheets according to claim 8, wherein the finishing rolling is effected by means of reversible-type rolling mill.

* * * * *